US008808006B2

(12) United States Patent
Ureles et al.

(10) Patent No.: US 8,808,006 B2
(45) Date of Patent: Aug. 19, 2014

(54) MULTIPLANAR DISPLAY SYSTEM

(75) Inventors: Jeff Ureles, Rochester, NY (US); Paul Dudley, Honeoye Falls, NY (US)

(73) Assignee: ID Signsystems, Inc., Rochester, NY (US)

( * ) Notice: Subject to any disclaimer, the term of this patent is extended or adjusted under 35 U.S.C. 154(b) by 131 days.

(21) Appl. No.: 13/308,767

(22) Filed: Dec. 1, 2011

(65) Prior Publication Data

US 2012/0196269 A1 Aug. 2, 2012

Related U.S. Application Data

(60) Provisional application No. 61/418,932, filed on Dec. 2, 2010.

(51) Int. Cl.

| | |
|---|---|
| ***B43L 23/00*** | (2006.01) |
| ***G09F 15/00*** | (2006.01) |
| ***B43L 1/12*** | (2006.01) |
| ***B43L 19/00*** | (2006.01) |
| ***G09F 1/12*** | (2006.01) |
| ***B43L 1/00*** | (2006.01) |
| ***B43K 23/00*** | (2006.01) |

(52) U.S. Cl.

CPC ..... *B43L 1/00* (2013.01); *G09F 15/0012* (2013.01); *B43L 1/12* (2013.01); *B43L 19/0056* (2013.01); *G09F 1/12* (2013.01); *G09F 15/0018* (2013.01); *B43K 23/002* (2013.01)

USPC ..... 434/415

(58) Field of Classification Search

USPC ..... 434/415

See application file for complete search history.

(56) References Cited

U.S. PATENT DOCUMENTS

| | | | | | |
|---|---|---|---|---|---|
| 4,427,391 | A * | 1/1984 | Berman | 434/408 |
| 5,163,845 | A * | 11/1992 | Blassingame | 434/408 |
| 5,176,522 | A * | 1/1993 | Robertson, Jr. | 434/415 |
| 5,207,582 | A * | 5/1993 | Michelson | 434/416 |
| 5,284,445 | A * | 2/1994 | Dietterich et al. | 434/419 |
| 5,682,695 | A * | 11/1997 | Hoffman | 40/594 |
| 5,752,837 | A * | 5/1998 | Palmer | 434/413 |
| 5,827,072 | A * | 10/1998 | Neufer et al. | 434/416 |
| 7,293,993 | B2 * | 11/2007 | Fedorov et al. | 434/408 |
| D569,433 | S * | 5/2008 | Gerules | D19/52 |
| 7,431,590 | B2 * | 10/2008 | Gerhardt | 434/408 |
| 7,497,406 | B2 * | 3/2009 | Hudson | 248/118.3 |
| D591,801 | S * | 5/2009 | Mak | D21/469 |
| D594,510 | S * | 6/2009 | Sappington et al. | D20/10 |
| D603,904 | S * | 11/2009 | Esfahani | D19/81 |
| D611,990 | S * | 3/2010 | Badinger | D19/52 |
| D623,226 | S * | 9/2010 | Hoch et al. | D19/52 |
| D623,693 | S * | 9/2010 | Hoch et al. | D19/52 |
| 7,793,142 | B2 * | 9/2010 | Clark et al. | 714/4.1 |
| 7,862,341 | B2 * | 1/2011 | Durand et al. | 434/408 |
| D643,878 | S * | 8/2011 | Osorio | D19/52 |
| D648,793 | S * | 11/2011 | Nash | D19/52 |
| 8,100,697 | B2 * | 1/2012 | Budryk et al. | 434/412 |
| D669,532 | S * | 10/2012 | Killian | D19/52 |
| 8,390,648 | B2 * | 3/2013 | Ptucha et al. | 345/638 |
| 2013/0079236 | A1 * | 3/2013 | Holmes | 506/9 |

* cited by examiner

*Primary Examiner* — Kurt Fernstrom
*Assistant Examiner* — Dolores Collins
(74) *Attorney, Agent, or Firm* — Duane C. Basch; Basch & Nickerson LLP

(57) ABSTRACT

Disclosed is a display system that combines the advantages of a dry-erase surface with a customized, interchangeable background so that information and or fields over which dry-erase markings are made are integrated with the background display.

24 Claims, 7 Drawing Sheets

MULTIPLANAR DISPLAY SYSTEM

This application claims priority from U.S. Provisional Patent Application 61/418,932 for a MULTIPLANAR DISPLAY SYSTEM, filed Dec. 2, 2010 by T. Axelrod and J. Ureles, which is hereby incorporated by reference in its entirety.

The disclosed system and method relates to a display board or system providing a readable display surface located behind a writing surface. Using the system, information is communicated both from the display surface and via a writing, using a dry-erase pen or the like, on the erasable writing surface. The disclosed system contemplates a discrete background, that is readily interchanged, and which serves to demarcate, categorize, label and/or identify specific foreground regions for additional writing. Due to the interchangeable nature of the background the regions may be periodically modified. Accordingly the foreground and background are combined to provide a format for the capture of variable data within a fixed background template that is readily interchanged with other pre-printed and/or customized background templates.

BACKGROUND AND SUMMARY

A typical dry erase board includes a board or substrate that is commonly coated with Melamine, a synthetic polymer, an enamel or porcelain. Specially designed dry-erase pens and markers are used to write on a white board substrate having a marking composition that leaves a residual or colored pigment behind. While the solvent within the ink of the marker evaporates, the remaining residual powder does not directly bond to the surface, accordingly the writing can be easily removed with an eraser or cloth. In some cases a "ghost" image remains whereby a liquid cleaner may be required to remove remaining dry-erase residue.

The dry erase marking boards generally comprise a rigid substrate such as a fiber board or metal having a surface coated with a non-porous, hard material. While such boards are useful for temporarily recording information, a disadvantage of dry erase boards is their inability to easily integrate "fixed" data fields or other graphics. Furthermore, once permanently applied, it is somewhat difficult or even impossible to change or remove any indicia that has been previously applied directly to the surface of the white board. Therefore, there is a need for a dry erase board which includes a fixed design, graphics or similar indicia and which further enables the design, graphics or indicia to be easily changed or exchanged on a periodic basis.

The present invention relates to a method and a system for the use of a spring clamping frame that allows for the containment of media framed therein where the media is readily interchangeable from the front side. As used herein, the term media generally refers to flexible substrates or flat surfaced items such as prints, pictures, posters or placards that are positioned for viewing within a surrounding frame, where the frame provides a clamping mechanism about the periphery to hold the media and a transparent overlay or member.

In one embodiment, the frame includes a plurality of clamps attached along the periphery of a rigid backer board, each clamp having a spring biased frame member pivotally mounted thereto, both of which are generally extrusions. In the closed position, the media or substrate is retained by the resiliently biasing frame members partially extending over the very peripheral edge of the media item. Additionally, a transparent, semi-rigid overlay sheet is included over the media to protect it and to keep the relatively flimsy substrate in direct contact with the backer board. Once in position the media background shows through the clear overlay sheet, which now serves as a guide or means to organize the data as it is written in conjunction with the background media.

Disclosed in embodiments herein is a multi-layer information display system, comprising: a transparent member providing a writable first surface (e.g., planar); said first surface being suitable to receive a mark from a marking device (e.g., dry-erase marker); a flexible, printed substrate located behind and generally coplanar with said transparent member, said substrate comprising a moisture resistant material; and a rigid member, generally coplanar with said first member and said substrate, said rigid member having movable peripheral clamping members along or adjacent some or all of the edges thereof to engage and retain the transparent member and the substrate in contact therewith.

The writable display information is directly associated with the underlying fixed data fields of the template printed on a substrate. Therefore the first plane or substrate layer is viewed as write once, read many, whereas the transparent member provides an outer surface that is read/write erasable data within one or more of the data illustrated by the template behind it.

Within the health care industry there is a growing requirement for patient-specific, need-to-know information to be communicated to concerned parties, including the staff, family and most importantly the patient. Accordingly administrative information such as phone numbers, duty nurse, room number, date, restrictions, diet and the like are typically made available to the patient. However a unified presentation system has not been generally available within health-care or similar long-term care facilities to permit the exchange of information, including recording, retention and updating means.

One aspect of the disclosed embodiments includes a unique combination of components for assembly of a frame for the purpose of displaying a writeable panel for viewing. While the disclosed embodiments are directed to a one-sided, wall-mount application, it will be appreciated that various aspects of the disclosed system may also be applicable to free standing signs, including two-sided exhibit signs providing changeable display substrates. Such display arrangements being readily updateable and changeable are effective, economical and practical because they include a re-writable foreground combined with an easily changeable background.

Figure 1:
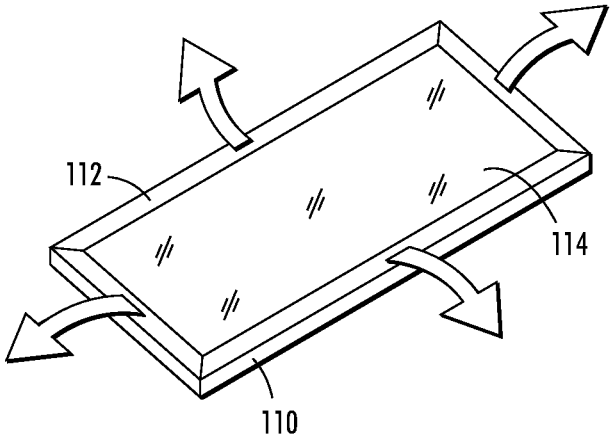
FIG. 1 shows the operation of a frame for use with the disclosed embodiments.

The various embodiments described herein are not intended to limit the disclosure to those embodiments described. On the contrary, the intent is to cover all alternatives, modifications, and equivalents as may be included within the spirit and scope of the various embodiments and equivalents set forth.

DETAILED DESCRIPTION

For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

In one embodiment, the clamping mechanisms described may be made from frames of the type conventionally known as "snap-frames" such as those available from VKF Renzel, Chicago, Ill. Such frames offer an advantage over conventional frame configurations in that they permit the interchange of the media item retained in the spring frame assembly. In a snap frame configuration the pivotal members are typically outwardly "sprung" from the base members such that the item retained against the backer board of the frame is released and can subsequently be lifted out from the front of the frame. An updated media item, such as a poster, menu, patient care sheet, can now be mounted within the frame in the same manner and is clamped in via the return force of the spring elements of the pivot members against the transparent cover member.

It is noted that one purpose of such a frame assembly is to provide a visually appealing presentation. Aside from displaying art work or an advertisement, the disclosed embodiment provides a solution for the recordation and updating of data having a both fixed and a variable component. For example, in the case where schedules are maintained on a monthly calendar, and are subject to change, the days of the week would constitute a substantially fixed field, whereas the scheduled entries represent a typical variable field. Accordingly, in one embodiment the fixed field resides on a high contrast substrate material which is inserted into a changeable frame, much like a poster, and the transparent cover member is placed over the substrate. Now with the clear cover member in position the fields, or regions on the substrate may be readily seen and those intended to be written on or over are able to be filled in by writing directly upon the transparent cover member without defacing the printed background sheet. With the use of conventional dry-erase markers, for example those available from Sanford Corp., Bellwood, Ill. under the trademark EXPO®, subsequent changes to information in the variable data regions are readily implemented.

Dry-erase ink contains pigments and release agents that prevent the pigment from sticking to dry erase boards and surfaces having non-porous characteristics. In accordance with the above example, it will be appreciated that at the end of a month the fixed field sheet can be simply interchanged with the subsequent month.

Figure 2:
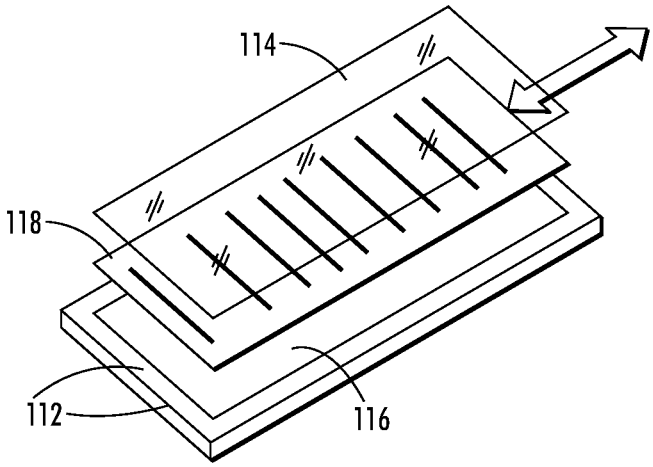
FIG. 2 is an exploded view of the frame depicted in FIG. 1.

Turning now to FIG. 1, a picture frame is shown whereby the spring-loaded movable clamps 112 are hinged to fixed frame members 110, which are further attached to a rigid backer board 116 to form a composite four sided rigid member. These frames are referred to as a "snap frames". FIG. 2 further illustrates the general operation of a snap frame where movable members 112 have been rotated outwardly to facilitate removal of transparent cover member 114, from the front, in order to access background substrate or media 118. A replacement background media 118 may be positioned within fixed frame 110, interposed between backer board 116, and clear cover 114, which protects media 118 once it is secured in placed by snapping movable members 112 to the closed position. Typical sizes for such members are 12"×24", 18"×24" and 24"×24", although smaller and larger sizes are easily accommodated.

In order to facilitate the use of the transparent cover member 114 as a writing surface, it is necessary to use a material that provides sufficient rigidity and is also resistant to damage or wear from dry-erase markers, erasers and cleaning agents. Conventional covers are made of relatively thin sheets of plastic having a low resistance to scratching, cracking and marring, and which are not completely erasable when written on with dry markers. Accordingly, in one embodiment the surface cover 114 must permit the use of dry-erase markers to provide and erasable and re-writable surface. A polymethyl methhacrylate, sold under the name of OPTIX® by Plaskolite, Inc, Columbus, Ohio, is one type of transparent material that exhibits all the suitable properties for a transparent cover member 114, including a high resistance to impact, as well as being erasable and cleanable with respect to dry-erase pigments. Notably, it has been further determined that applying a scratch resistant coating such as Armadillo™ also available from Plaskolite, may be advantageous to improve the resistance of the polymer sheet to abrasions and solvents. Such a coating may further mitigate hazing due to scratches in order to maintain a clear and unobstructed view of background media 118. It should be further appreciated that the not only is the transparent cover member 114 replaceable, without having to replace the entire frame, but it may also be reversible and or rotatable (depending upon the shape/dimensions of the frame) so that extended life, even in the event of minor wear, may be possible.

Figure 3:
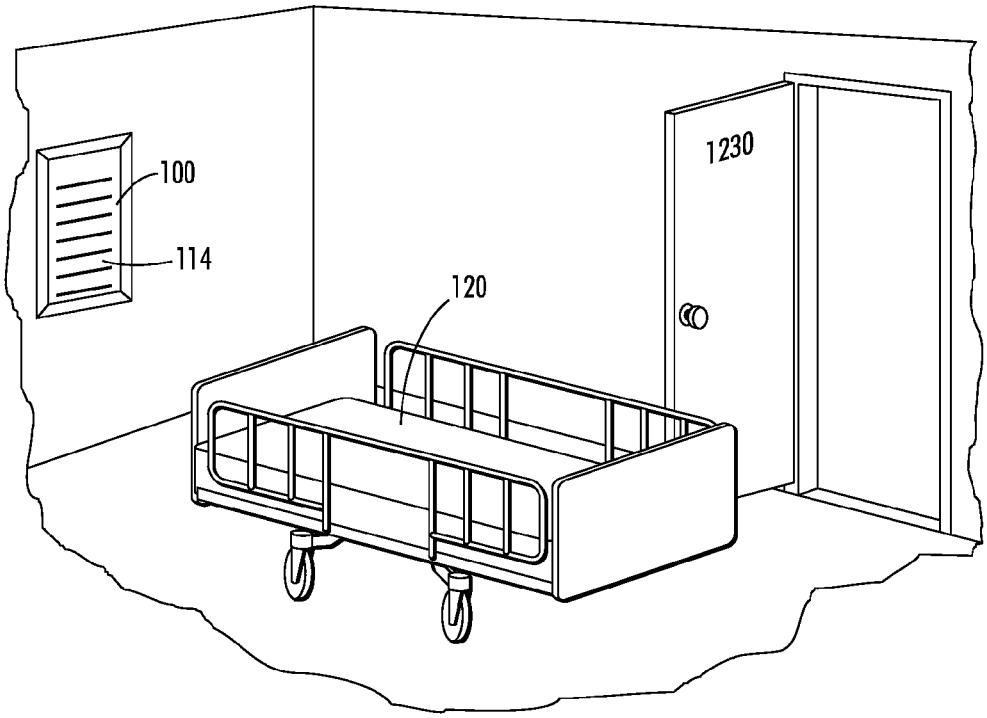
FIG. 3 is a view of an exemplary system used within a hospital room.

Another embodiment of the display system 100 is illustrated in FIG. 3, where system 100 is shown in a hospital setting. Again a fixed data field is printed on media 118 to guide the recording of transitory information, some, or all, of which have the potential of changing on a routine basis. As more specifically illustrated in FIG. 4, an expanded view of the media or substrate in system 100 in FIG. 3, specific fields or regions are depicted suggesting the entry of data, such as name, date and attendants. Furthermore, as a communication link to and from all concerned parties, message field 104 is provided whereby any individual may convey information to others at anytime by simply writing in the field. In the case of special instructions, field 105 provides a means for a care giver to relay non-critical information that may not have been, for whatever reason, recorded in the patient's chart. System 100 should be securely mounted (e.g., with screws or similar fasteners) to a wall so as not to move about when writing or erasing information. Additionally system 100 should generally be in clear view of the patient, as well as those individuals entering the room as depicted in FIG. 3.

Although primarily discussed herein for use in a health institution, such as a hospital, nursing home or rehabilitation center, it will be appreciated that all of the aspects of embodiments disclosed herein may be of a benefit in business and manufacturing environments as well, where a variable template is useful to assist in filing in the blanks with a dry-erase marking device. A characteristic example might be a posted menu for a restaurant where the catch of the day are listed or items having variable prices may be printed on the substrate and the daily price filled in. In a manufacturing setting various production metrics could be recorded on a periodic basis in the form of a graph or tabular form.

Figure 5:
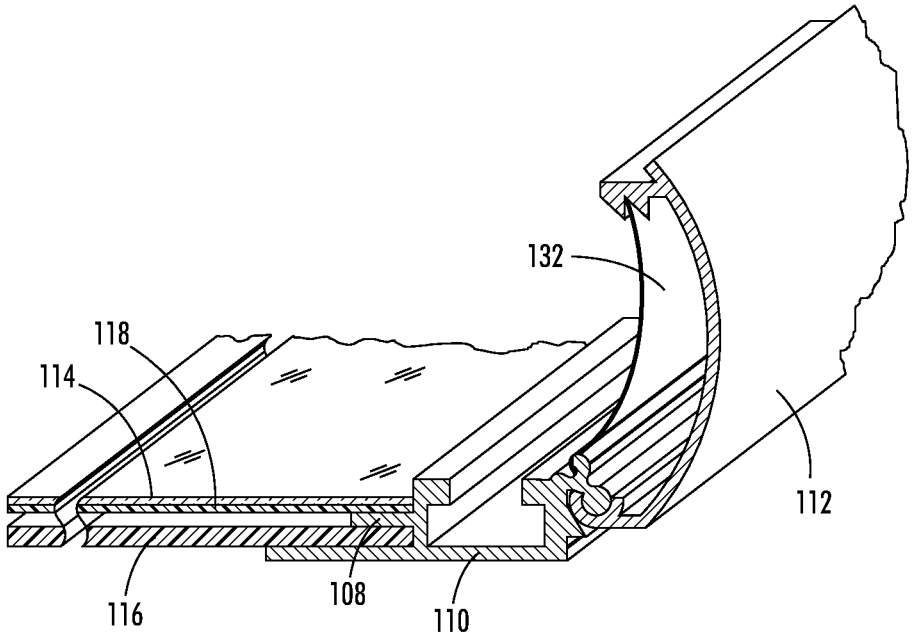
FIG. 5 is an isometric sectional view of a frame in an open position.

In one embodiment, as illustrated in FIGS. 5 and 6, a modified snap frame is shown in the open, or loading, position and in a closed position, respectively. Transparent cover 114, as noted above, comprises a sheet of OPTIX® Acrylic plastic (e.g., 0.080"-0.125") which is used in the place of glass. A thinner thickness or other material may result in "oil canning" of the surface that would make it difficult to write on, and may also encourage seepage onto the background media or substrate when cleaning. It will be appreciated that thicker materials may be employed if desired, and may be advantageous for large-sized applications. In light of an increased thickness of the OPTIX® sheet, spacer 108, of fixed frame member 110, is reduced in thickness an amount equal to the increased thickness of transparent cover 114. This dimensional alteration is required to ensure that the mitered corners of the four movable frame members 112 remain in alignment when in the closed position (e.g., FIG. 6).

Figure 4:
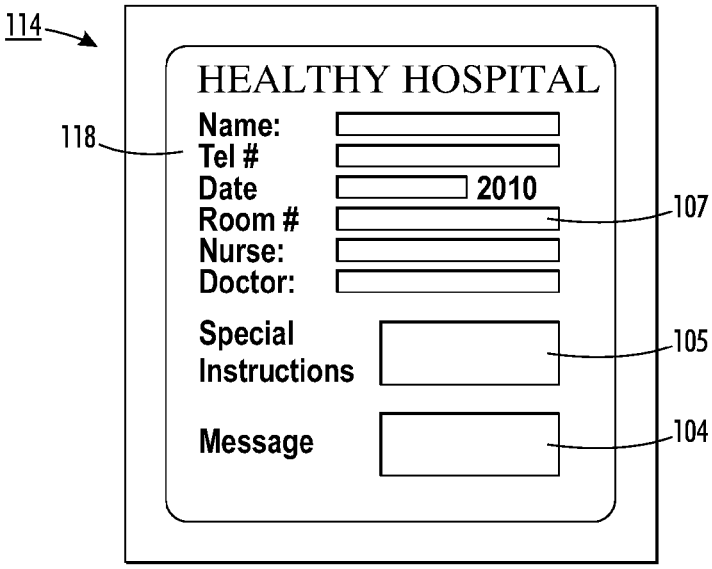
FIG. 4 is a close-up planar view of the background media of the system of FIG. 3.

The writable surface of cover member 114, sometimes requires cleaning with a liquid solvent to remove the residual ink that has built up, or in the case of non-erasable markers, to remove the actual writing. In a healthcare setting periodic cleaning for purposes of disinfecting the surfaces is also required. Commercial cleaners typically contain both an ethanol and an alcohol, each of which have a specific gravity that is 20% less than water. Referring to FIG. 4, as clear surface 114, of placard 100, is sprayed with the cleaner, these chemicals, having a relatively low specific gravity, have a tendency to egress under the lower most frame member 112 and seep around spacer 108 thereby coming into contact with the printed paper of the background media, as can be seen in the cross-sectional view of FIG. 6A. This presents a significant issue as to the longevity of the substrate and the printing thereon as the chemical agents are subsequently absorbed up into the paper of the background media, which disturbs the ink and/or discolors the paper. While in one case this may not present a significant issue in situations where the media 118 is replaced in regular, short-term, intervals, alternative solutions are contemplated as well.

One alternative way to solve such problems, is to use a substrate and/or ink that is resistant to damage by cleaning solutions, such as an 8 mil polypropylene matte film material having a water-resistant coating that is compatible with both dye and UV ink for the printed media, and yet impervious to most liquid cleaners. Thus, in accordance with such an embodiment, the media and/or printing ink are impervious to the cleaning solutions and solvents that may be used to clean not only the dry-erase markings on the outer surface of cover 114, but also any other cleaners such as disinfectants and the like that may be used in hospital, nursing and similar patient care facilities.

Figure 6A:
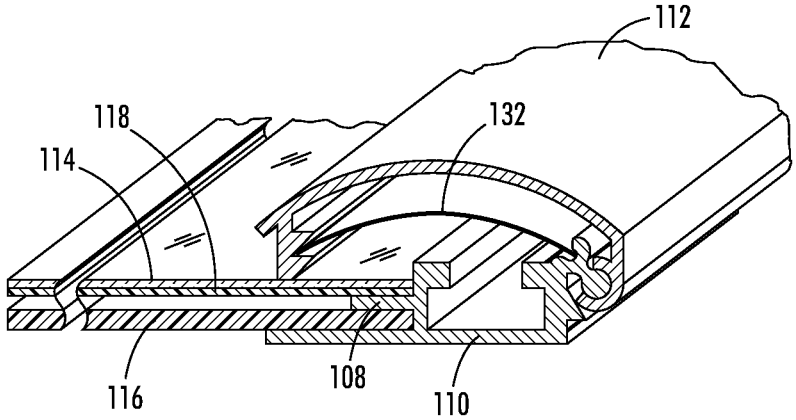
FIG. 6A is a planar sectional view of a frame in a closed position.
Figure 6B:
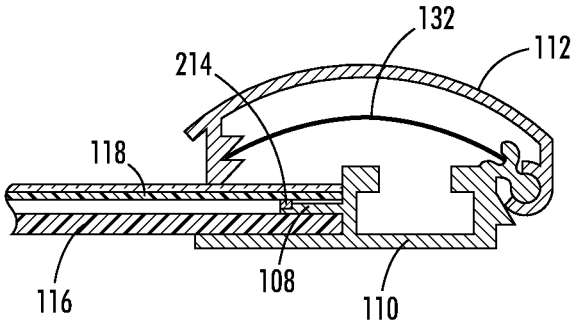
FIGS. 6B-6D are planar sectional views of the frame illustrating various gasketing alternatives.
Figure 6C:
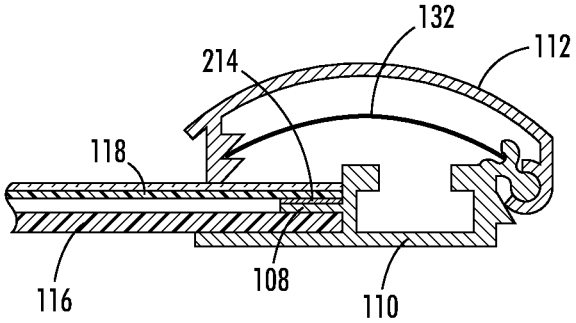
Figure 6D:
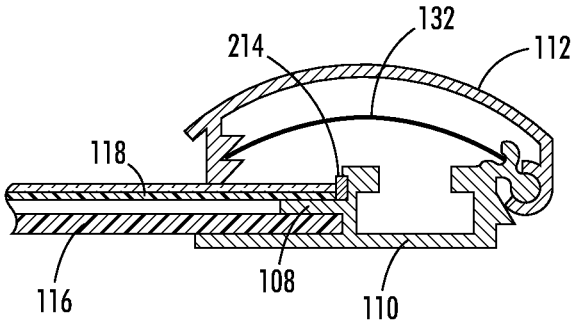

In the alternative, as depicted in FIG. 6B, a fluid barrier, such as a gasket or caulk could be placed along the front (writable) or rear surface and/or an edge of the cover 114 to prevent or reduce the amount of cleaning or other fluid coming into contact with the media 118. For example, FIG. 6B shows the gasket material placed at location 210, along the outer edge of spacer 108 that would subsequently prevent or reduce the cleaning fluid entering within the body of the frame. An alternative placement of the gasket is depicted in FIGS. 6C-6D, In FIG. 6C, the gasket is placed at 212, along a surface of spacer 108, whereas in FIG. 6D, the gasket material is placed at 214 along the interior shoulder of frame member 110, where the spacer meets the frame member, so that the gasket largely contacts the edge of the cover 114 when installed into the frame 110. Although depicted in rectangular cross-sections, it will be appreciated that any of the gaskets shown in FIGS. 6B-6D may have differently shaped cross-sections in order to improve the ability to form a seal between the frame 110 and the cover 114. It will also be appreciated that a combination of gaskets may be employed as illustrated, and that the gasket material may only be used for certain portions (e.g., only along the frame bottom where liquid is likely to collect during cleaning). Lastly, it is further contemplated that the media 118 may also have a gasket-like coating or material applied to it along the edges so as to provide or form, in combination with the medium being clamped between the cover 114 and spacer 108, a gasket or barrier to limit liquid being drawn toward the media.

Figure 7:
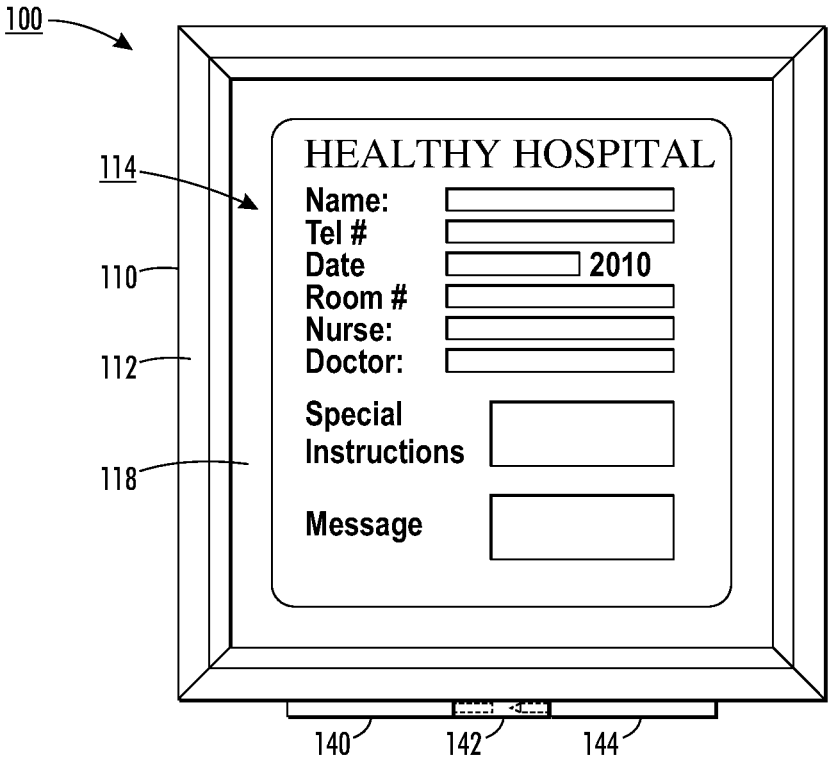
FIG. 7 is a view of FIG. 4 further including an optional marker holder.
Figure 8:
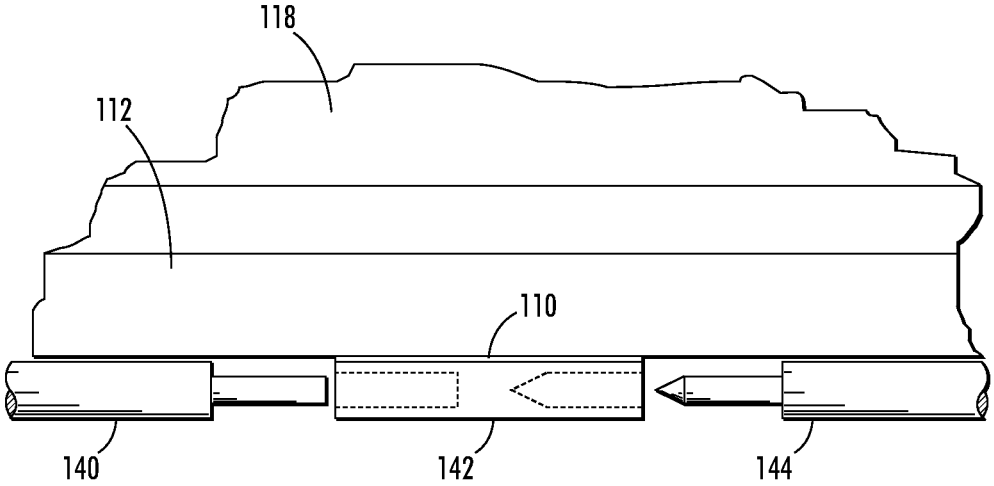
FIG. 8 is a detail drawing of the marker holder of FIG. 7.

In another embodiment, as shown in FIGS. 7 and 8, system 100 may include a retainer to store a dry marker and/or an eraser or a combination marker/eraser assembly. Dry-erase marker 144 is readily accessible at all times to promote the use of system 100. Notably, an erasable marker, once uncapped, has a tendency for the solvent to readily evaporate and thereby leaving the dried dye component of the ink on the tip of the market, absent a dispersing solvent. Thus using the capping member (part of holder 142) as part of the retainer for the marker assures that the marker will be replaced and will not dry out prematurely. In FIG. 7, marker/eraser holder 142 is shown permanently attached to fixed member 110 and backer board 116 (not shown) for the purpose of defining a designated and permanent storage location for marker 144, as well as eraser 140. Notably holder 142 serves to provide an air tight seal while retaining marker 144 therein. It will be appreciated that the holder 142 may be attached or applied at various locations about or even separated from the display system 100. Eliminating the discrete marker cap will ensure that it is not misplaced and by means of holder 142, marker 144 will be readily available and not mislaid as well. It is further intended to provide a storage means for eraser 140, as seen in this embodiment where both the marker and eraser cohabitate in readily accessible holder 142. Various alternatives are contemplated whereby eraser 140 and marker 144 include separate mounting and retention arrangements along the periphery of system 100 or separately mounted within reach on the wall.

Figure 9:
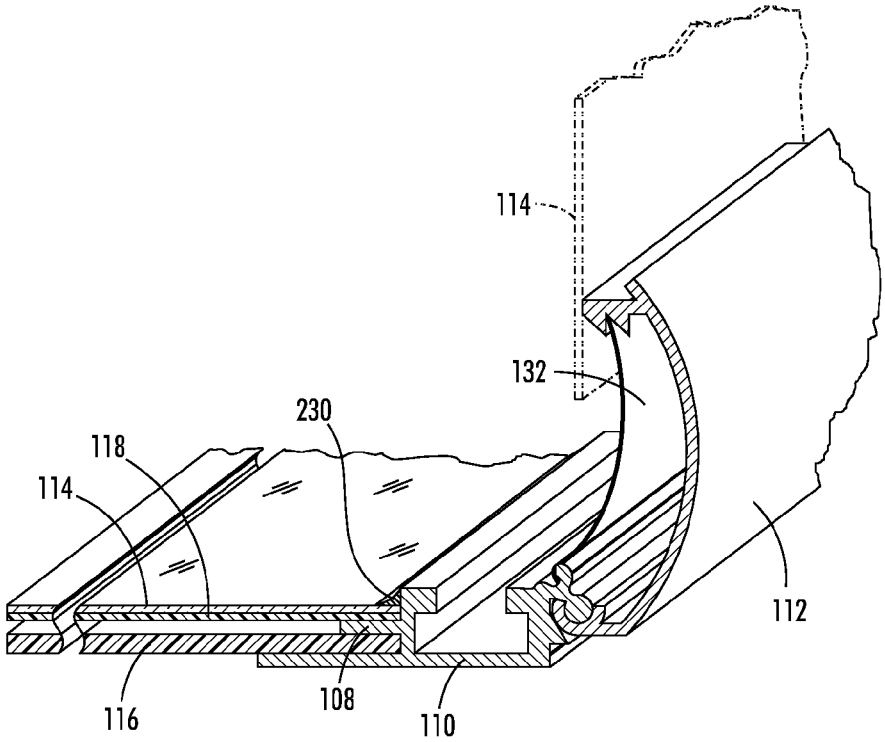
FIGS. 9-11 are isometric sectional views illustrating several alternative features to reduce wicking of liquids.
Figure 10:
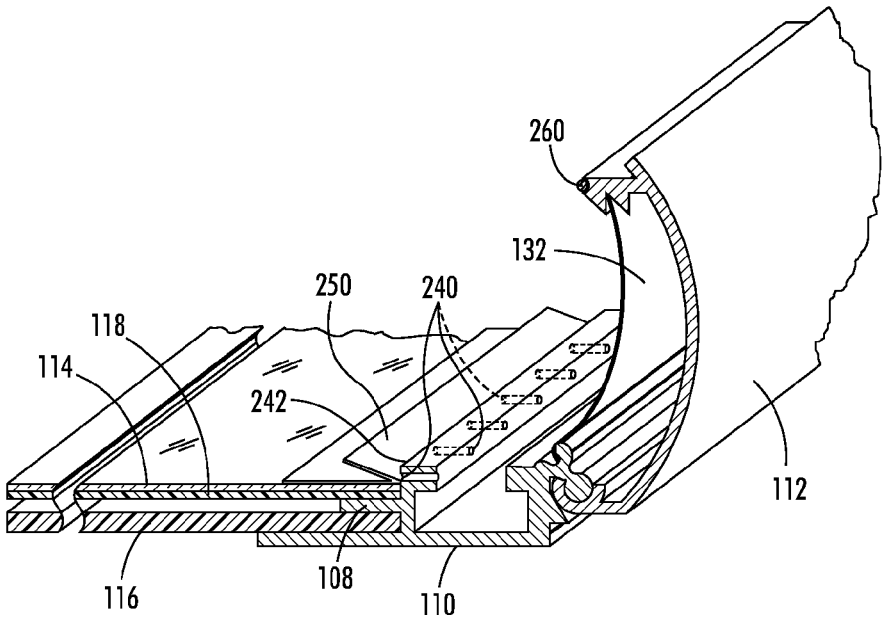
Figure 11:
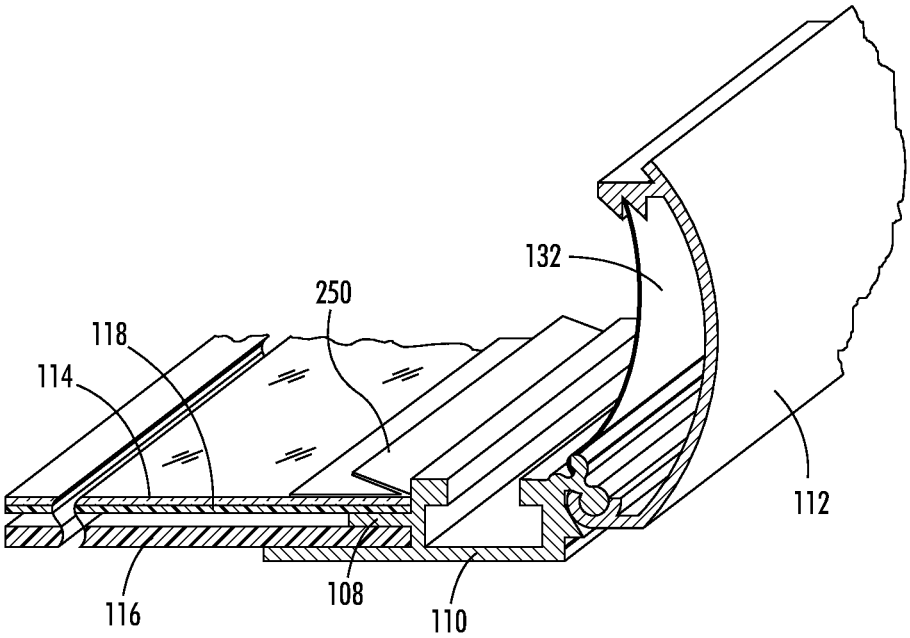

Turning next to FIG. 9, depicted therein is a modified snap frame as in FIG. 5, once again shown in the open, or loading, position in order to illustrate alternative features suitable for controlling liquid along at least the bottom-most member of the snap frame (the illustration of FIGS. 9-11 representing a lowermost portion of the frame). In addition to the illustrations various gaskets in FIGS. 6B-6D, the features of FIGS. 9-11 further illustrate various means for reducing the pooling of liquid along at least the bottom edge of the transparent member or cover 114. As previously noted, the transparent cover 114, along with underlying media 118 is held in place by the snap frame clamping member 112. This dimensional alteration is required to ensure that the mitered corners of the four movable frame members 112 remain in alignment when in the closed position (e.g., FIG. 6). FIG. 9 depicts two alternatives for the control of cleaning liquids that may be used on the display system when is in use (i.e., when the clamping frame member 112 is in contact with the cover 114, even though shown in an open configuration for illustration).

One alternative is the use of a modification to the front surface of the cover 114, to encourage the liquid to collect or run off to the sides of the frame so as to avoid pooling liquid at the edge of the frame where the cover 114 rests (e.g., see surface 242 in FIG. 10). In one embodiment the front of the cover sheet might have a groove cut therein to catch and retain liquid or direct it to the sides. Another possibility as illustrated is a structure 230 applied to the surface of cover 114, where the structure collects or channels liquid to prevent it from pooling at the lower edge of the cover and then wicking up the back surface of the cover through capillary action.

Structure 230 may be an additional layer of the material that cover 114 114 is made from, or an alternative material that is affixed or adhered to the cover surface. Various materials may be employed, including: a bead of silicone or similar sealants or caulks, flexible, adhesive-backed materials such as water-resistant tapes, V-shaped vinyl weather-stripping or the like, and channel-shaped members adhered to the front of cover 114 using adhesives or bonding tapes (e.g., viscoelastic bonding VHB™ tape from 3M™), chemical or heat welding, etc.

Also depicted in FIG. 9 is another optional embodiment where the cover 114 is, itself, adhered to the clamp member 112 of the snap frame and thereby creates a continuous seal between the front of the cover and the frame to prevent liquid from pooling at the lower edge of cover 114. In this embodiment, the operation of the frame is changed slightly such that the media 118 is changed by opening up the sides and top snap frame members and then tilting the cover 114 and lower frame clamp member 112 outward (pivoting at the bottom). Once again, the second alternative embodiment may be employed separately or in conjunction with other elements depicted in FIG. 9.

Considering FIG. 10, one embodiment used to control the pooling of liquid along the bottom edge of cover 114 is the inclusion of weep holes or channels 240 along the lower edge of the cover where it contacts or rests upon the frame at shoulder 242. The holes or channels would serve to direct liquid away from the bottom edge and thereby discourage pooling and wicking up the back side of the cover.

Also illustrated in FIG. 10 is yet a further gasket similar to those described relative to FIGS. 6B-6C. In the case of gasket 260, the gasket material is affixed to an edge of clamping member 112, and comes into contact with the front surface of the cover 114 when the clamp member 112 along the bottom of the frame is closed. The clamping force serves to place the gasket 260 into contacts with the cover and reduces the liquid likely to pool at the bottom edge of the cover.

In FIG. 11, there is illustrated the use of an additional material such as a V-shaped channel or gutter 250 that is affixed to the outer surface of the cover 114 near the lower edge (behind or covered by the snap frame member 112 when closed). The channel or gutter serves to prevent any liquid from continuing to the bottom edge of the cover and either retains the liquid to evaporate or directs liquid toward the sides of the cover. A channel such as 250 may be formed using a V-shaped material such as vinyl weather-stripping having an adhesive backing along at least the surface in contact with the cover. As will be appreciated, the use of gasketing materials and other liquid control techniques as illustrated in FIGS. 6B-6C and 9-11, may be done separately or in combination with one another.

It should be understood that various changes and modifications to the embodiments described herein will be apparent to those skilled in the art. Such changes and modifications can be made without departing from the spirit and scope of the present disclosure and without diminishing its intended advantages. It is therefore anticipated that all such changes and modifications be covered by the instant application.

What is claimed is:

1. A multi-layer information display system, comprising:

a transparent planar member providing a writable first surface; said first surface being suitable to receive a mark from a dry-erase marking device;

a generally planar backer board;

a flexible, preprinted substrate located behind and generally coplanar with said transparent member and in front of said backer board, said substrate comprising a moisture resistant material; and a rigid frame, said frame including movable peripheral clamping members along at least some of the edges of said transparent member to engage and retain the transparent member and the substrate in contact with said frame and said backer board.

2. The system of claim 1, wherein the substrate is removable to interchange the preprinted substrate.

3. The system of claim 1 wherein said transparent member comprises a polymethyl methhacrylate panel.

4. The system of claim 1 wherein said movable peripheral clamping member includes a hinged component and a tensioner.

5. The system of claim 4 further wherein said peripheral clamping member is mounted along the entire edge of the rigid member.

6. The system of claim 1 further including a retainer for the marking pen.

7. The system of claim 1 further including a retainer for an eraser suitable to erase the mark from a dry-erase marking device from said first surface.

8. The system of claim 1, wherein said flexible substrate includes a polypropylene matte film material having a water-resistant coating compatible with both dye and UV ink.

9. The system of claim 1, wherein said flexible substrate includes a polypropylene matte film.

10. The system of claim 1 further including a gasket between said frame and said transparent member, said gasket limiting the flow of a liquid therethrough.

11. The system of claim 10, wherein the gasket contacts the first surface of the transparent member.

12. The system of claim 10, wherein the gasket contacts a rear surface of the transparent member.

13. The system of claim 10, wherein the gasket contacts an edge of the transparent member.

14. The system of claim 1 further including a structure in contact with the first surface to reduce the pooling of liquid along at least the bottom edge of the transparent member.

15. The system of claim 1 further including channels in said rigid frame to reduce the pooling of liquid along at least the bottom edge of the transparent member.

16. The system of claim 1, wherein said flexible, preprinted substrate includes at least one coating on a surface thereof.

17. The system of claim 1, wherein said preprinted substrate includes a coating that is impervious to a liquid cleaner.

18. A multi-layer information display system having a transparent member, and a rigid frame, generally coplanar with said transparent member, said rigid frame having movable peripheral clamping members along all of the edges thereof to engage and retain the transparent member in contact therewith, wherein the improvement comprises:

said transparent member having a writable first surface suitable to receive a mark from a dry-erase marking device and to further permit erasure of the mark; and a flexible, preprinted substrate located behind and generally coplanar with said transparent member yet visible through said transparent member, said substrate comprising a moisture resistant material.

19. The system of claim 18, wherein the substrate includes a polypropylene matte film material having a water-resistant coating compatible with both dye and UV ink.

20. The system of claim 19 wherein said transparent member comprises a polymethyl methhacrylate panel.

21. The system of claim 20 wherein said transparent member includes a scratch resistant coating on at least the first writable surface.

22. The system of claim 18 further including means for reducing the pooling of liquid at the bottom edge of the transparent member.

23. The system of claim 18, wherein said preprinted substrate has at least one coating on a surface thereof.

24. The system of claim 18, wherein said preprinted substrate includes a coating that is impervious to a liquid cleaner.

* * * * *